US006514102B1

(12) United States Patent
Murakami et al.

(10) Patent No.: US 6,514,102 B1
(45) Date of Patent: Feb. 4, 2003

(54) WATERPROOF CONNECTOR AND WATERPROOFING METHOD

(75) Inventors: Takao Murakami, Shizuoka-ken (JP); Masaru Fukuda, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/281,005

(22) Filed: Mar. 30, 1999

(30) Foreign Application Priority Data

Mar. 31, 1998 (JP) ..... 10-087116

(51) Int. Cl.[7] ..... H01R 13/40

(52) U.S. Cl. ..... 439/587

(58) Field of Search ..... 439/587, 275, 439/598, 274, 279, 523, 456, 459

(56) References Cited

U.S. PATENT DOCUMENTS

| | | | |
|---|---|---|---|
| 3,879,239 A | 4/1975 | Rager et al. | 156/73.1 |
| 4,083,902 A | 4/1978 | Clyde | 264/26 |
| 4,640,567 A | 2/1987 | Lundergan et al. | 339/94 |

(List continued on next page.)

FOREIGN PATENT DOCUMENTS

| | | |
|---|---|---|
| EP | 0 299 797 | 1/1989 |
| EP | 0 546 753 A1 | 6/1993 |
| EP | 0 631 344 A2 | 6/1994 |
| EP | 0 691 710 A2 | 1/1996 |
| EP | 0 700 125 A2 | 3/1996 |
| EP | 0 778 636 A1 | 6/1997 |
| FR | 2415375 | 8/1979 |
| FR | 2753008 | 3/1998 |
| GB | 2168548 A | 6/1986 |
| GB | 2 321 346 A | 7/1998 |
| GB | 2 321 347 A | 7/1998 |
| GB | 2 321 792 A | 8/1998 |
| GB | 2 321 802 A | 8/1998 |
| JP | 50-54591 | 5/1975 |
| JP | 61-12621 | 4/1986 |
| JP | 62-188069 | 11/1987 |
| JP | 64-63282 | 3/1989 |
| JP | 4-49480 | 4/1992 |
| JP | 4-101380 | 9/1992 |
| JP | 5-152028 | 6/1993 |
| JP | 6-217412 | 8/1994 |
| JP | 6-295750 | 10/1994 |
| JP | 7-22079 | 1/1995 |
| JP | 7-122331 | 5/1995 |
| JP | 07201395 | 8/1995 |
| JP | 7-298450 | 11/1995 |
| JP | 07326424 | 12/1995 |
| JP | 8-186901 | 7/1996 |
| JP | 9-45376 | 2/1997 |
| JP | 09082394 | 3/1997 |
| JP | 10-60096 | 3/1998 |
| JP | 10-92478 | 4/1998 |
| WO | WO 96/32760 | 10/1996 |
| WO | WO 97/36346 | 10/1997 |

*Primary Examiner*—Neil Abrams
*Assistant Examiner*—J. F. Duverne
(74) *Attorney, Agent, or Firm*—Finnegan, Henderson, Farabow, Garrett, & Dunner, L.L.P.

(57) ABSTRACT

A housing (13) includes a terminal accommodation chamber in which a terminal (11) is accommodated, a sealing portion (14) is provided at a rear end **(13*a*) of an electric wire outlet side of the housing (13) for sealing the inside of the terminal accommodation chamber, and a soft sealing material (15) is assembled in the sealing portion (14). The soft sealing material (15) has an insertion hole (16) greater in section than the terminal (11), and the sealing portion (14) is provided with a sealing material accommodation space (17) in which the soft sealing material (15) is inserted, and has push members (29) for tightly adhering and tight contacting the soft sealing material (15) in the sealing material accommodation space (17) to an outer periphery of the electric wire (18) by pressing the soft sealing material (15) to shrink the insertion hole (16)**.

18 Claims, 5 Drawing Sheets

U.S. PATENT DOCUMENTS 4,643,506 A 2/1987 Kobler
4,662,629 A 5/1987 Plovie ..... 272/62
4,662,692 A 5/1987 Uken et al.
4,684,187 A 8/1987 Rudy, Jr. et al. ..... 439/600
4,708,662 A 11/1987 Klein ..... 439/353
4,713,021 A 12/1987 Kobler
4,776,813 A * 10/1988 Wilson et al. ..... 439/587
4,944,688 A 7/1990 Lundergan ..... 439/275
4,969,260 A 11/1990 Kondo et al. ..... 29/863
4,976,634 A 12/1990 Green et al. ..... 439/589
4,979,913 A 12/1990 Aiello et al. ..... 439/596
5,116,236 A 5/1992 Colleran et al. ..... 439/271
5,120,269 A 6/1992 Endo et al. ..... 439/752
5,215,635 A 6/1993 Stein et al. ..... 204/157.62
5,240,431 A 8/1993 Yagi et al. ..... 439/271
5,266,045 A 11/1993 Yamanoto et al.
5,316,504 A 5/1994 Jinno ..... 439/752
5,419,722 A 5/1995 Onoda ..... 439/752
5,490,572 A 2/1996 Tajiri et al. ..... 180/65.1
5,498,170 A 3/1996 Tanaka ..... 439/271
5,529,508 A 6/1996 Chiotis et al. ..... 439/204
5,562,477 A 10/1996 Moore et al. ..... 439/383
5,569,050 A 10/1996 Lloyd ..... 439/465
5,580,264 A 12/1996 Aoyama et al. ..... 439/275
5,596,261 A 1/1997 Suyama ..... 320/48
5,613,868 A 3/1997 Ohsumi et al.
5,645,451 A 7/1997 Ohsumi et al. ..... 439/587
5,707,251 A 1/1998 Sakai et al. ..... 439/589
5,709,563 A 1/1998 Saito ..... 439/272
5,730,627 A 3/1998 Okabe ..... 439/752
5,782,657 A 7/1998 Wolla et al. ..... 439/595
5,803,773 A 9/1998 Kashiyama et al. ..... 439/752
5,836,788 A * 11/1998 Torii ..... 439/587
5,860,834 A 1/1999 Sugiyama ..... 439/595
5,931,699 A * 8/1999 Saito ..... 439/587
5,931,707 A 8/1999 Ito ..... 439/752
5,947,774 A 9/1999 Abe ..... 439/701
5,984,737 A 11/1999 Nagano et al. ..... 439/752

* cited by examiner

WATERPROOF CONNECTOR AND WATERPROOFING METHOD

BACKGROUND OF THE INVENTION

1. Field of the Invention

The present invention relates to a waterproof connector of the type in which a connector housing has a terminal accommodation chamber sealed with a "body of soft sealing material" (hereafter simply called "soft sealing material"), and to a waterproofing method therefor.

2. Description of the Prior Art

There have been disclosed waterproof connectors of such a type in U.S. Pat. No. 4,662,692, Japanese Patent Application Laid-open Publication No. 64-63282 and Japanese Utility Model Application Laid-open Publication No. 4-101380.

A conventional waterproof connector of this type includes a housing in which a terminal accommodation chamber is formed, a terminal connected to an end of an electric wire and accommodated in the terminal accommodation chamber, and a soft sealing material for sealing the inside of the terminal accommodation chamber. The soft sealing material comprises a body of a gel, such as of silicon, and tight contacts on an inner wall of the housing and an outer periphery of the electric wire so as to prevent water from entering into the terminal accommodation chamber from a space between the outer periphery of the electric wire and the inner wall of the housing.

The soft sealing material is mounted on a wire outlet side of the housing, and is prevented from dropping out of the housing by means of a stopper member inserted in a rear end of the housing. The soft sealing material is formed with a plurality of slits through which the terminal and the electric wire are inserted.

In the waterproof connector, in order to assemble the terminal to the housing, the soft sealing material is inserted in the housing from an opening formed at the outlet side of the electric wire and tight contacted on the inner wall of the housing, and in this state, the terminal is accommodated. Next, the stopper member is inserted in the rear end, thereby preventing the soft sealing material from dropping out.

From this state, the terminal is inserted in the slit and forced through the slit, so that the terminal is inserted and accommodated in the terminal accommodation chamber, and the electric wire is inserted through the slit.

At that time, as the soft sealing material is surrounded by the inner wall of the housing, the slit is compressed and tight contacted on the outer periphery of the electric wire.

By this structure, water is prevented from entering from the space between the outer periphery of the electric wire and the inner wall of the housing.

From this state, as the terminal is inserted through the compressed slit, the terminal scrapes the soft sealing material. Further, scraps of soft sealing material are carried with the terminal in the terminal accommodation chamber. Therefore, when the terminal is connected to a mating terminal, the scraps of soft sealing material which is an insulating material intervene between the terminals, and the sureness of the connection is deteriorated.

Scraped soft sealing material causes a deterioration of waterproof performance.

SUMMARY OF THE INVENTION

The present invention has been achieved with such points in view.

It therefore is an object of the present invention to provide a waterproof connector and a waterproofing method therefor, without causing a terminal to scrape a soft sealing material nor to carry scraps thereof, allowing the soft sealing material to have a maintained sealing performance.

To achieve the object, an aspect of the invention provides a waterproof connector which comprises a terminal connected to an electric wire, a housing having a chamber for accommodating the terminal and a passage for passing the electric wire, and a soft sealing body for sealing the passage with a sealing configuration thereof, the soft sealing body having an insertion hole for the terminal to be inserted therethrough to the chamber, and in which the soft sealing body is pressed to be compressed from an initial configuration thereof, where the insertion hole is larger in section than the terminal, to the sealing configuration, where the insertion hole tight contacts on the electric wire.

According to the aspect of the invention, the terminal connected to the electric wire can be inserted to the chamber through the insertion hole which is larger in section than the terminal in the initial configuration of the soft sealing body, without scraping an inside of the insertion hole nor carrying scraps to the chamber, before the soft sealing body is pressed for compression to the sealing configuration in which the insertion hole tight contacts on the electric wire, so that an effective sealing is achieved around the electric wire, as well as to the passage.

Further to achieve the object described, another aspect of the invention provides a waterproof connector fabrication method comprising the steps of providing a housing having a chamber with a passage, connecting a terminal to an electric wire, providing a soft sealing body with an initial configuration thereof having an insertion hole larger in section than the terminal, inserting the terminal through the insertion hole to the chamber, thereby accommodating the terminal in the chamber with the electric wire passing the passage; and pressing the soft sealing body to be compressed from the initial configuration thereof to a sealing configuration thereof in which the insertion hole tight contacts on the electric wire, thereby sealing the passage.

According to this aspect also, there can achieved like effects to that aspect of the invention.

BRIEF DESCRIPTION OF THE ACCOMPANYING DRAWINGS

The above and further objects and novel features of the present invention will be more fully appear from the following detailed description when the same is read in conjunction with the accompanying drawings, in which:

FIGS. 5A an 5B show structures in the waterproof connector, in which FIG. 5A is a section along line A—A of FIG. 3.

DETAILED DESCRIPTION OF THE PREFERRED EMBODIMENTS

Figure 1:
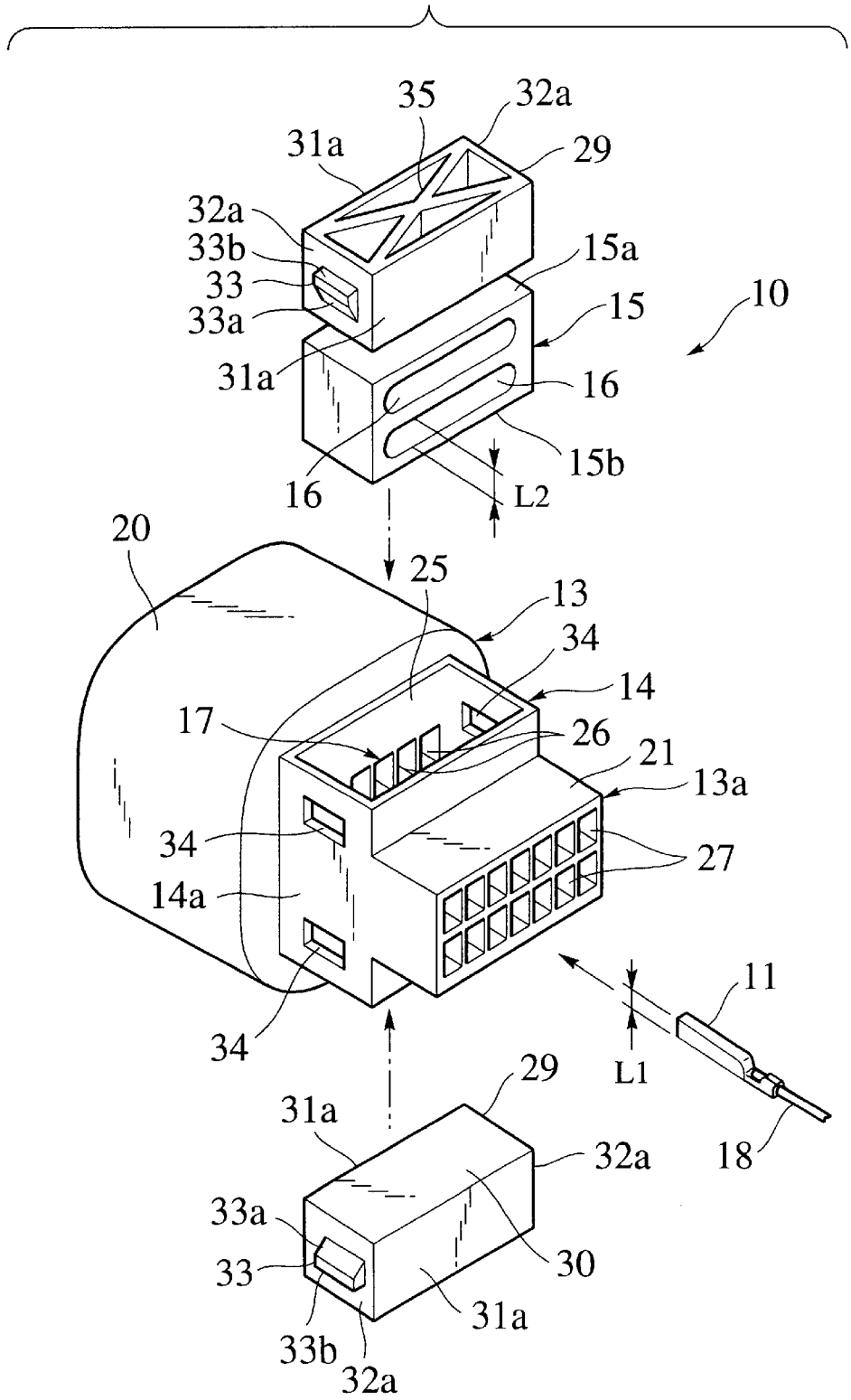
FIG. 1 is an exploded perspective of a waterproof connector according to an embodiment of the invention.

There will be detailed below the preferred embodiments of the present invention with reference to the accompanying drawings. Like members are designated by like reference characters.

Figure 2:
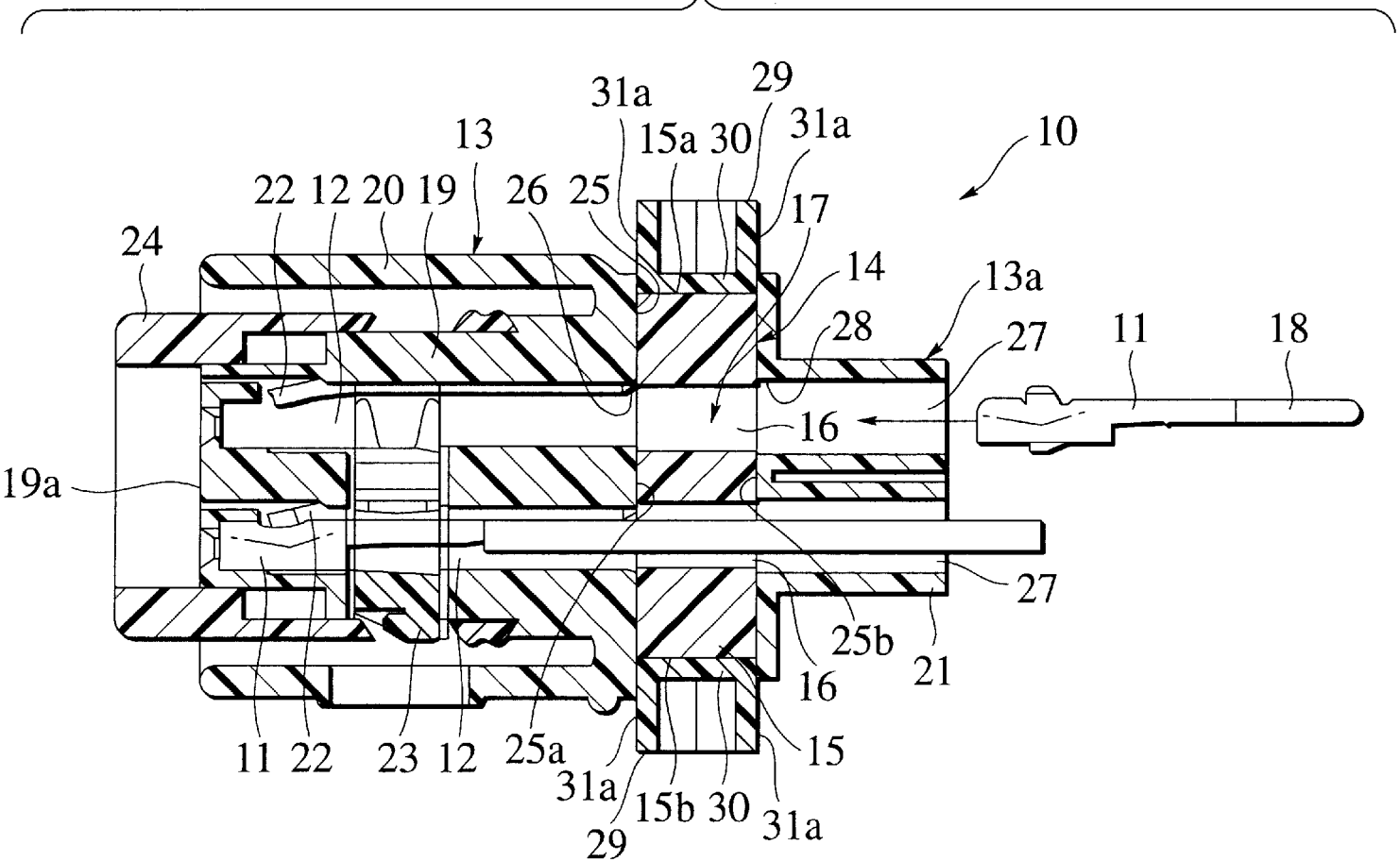
FIG. 2 is a longitudinal section of the waterproof connector in which a terminal is on a way of application for accommodation to a terminal accommodation chamber, and a soft sealing material has an initial configuration.
Figure 3:
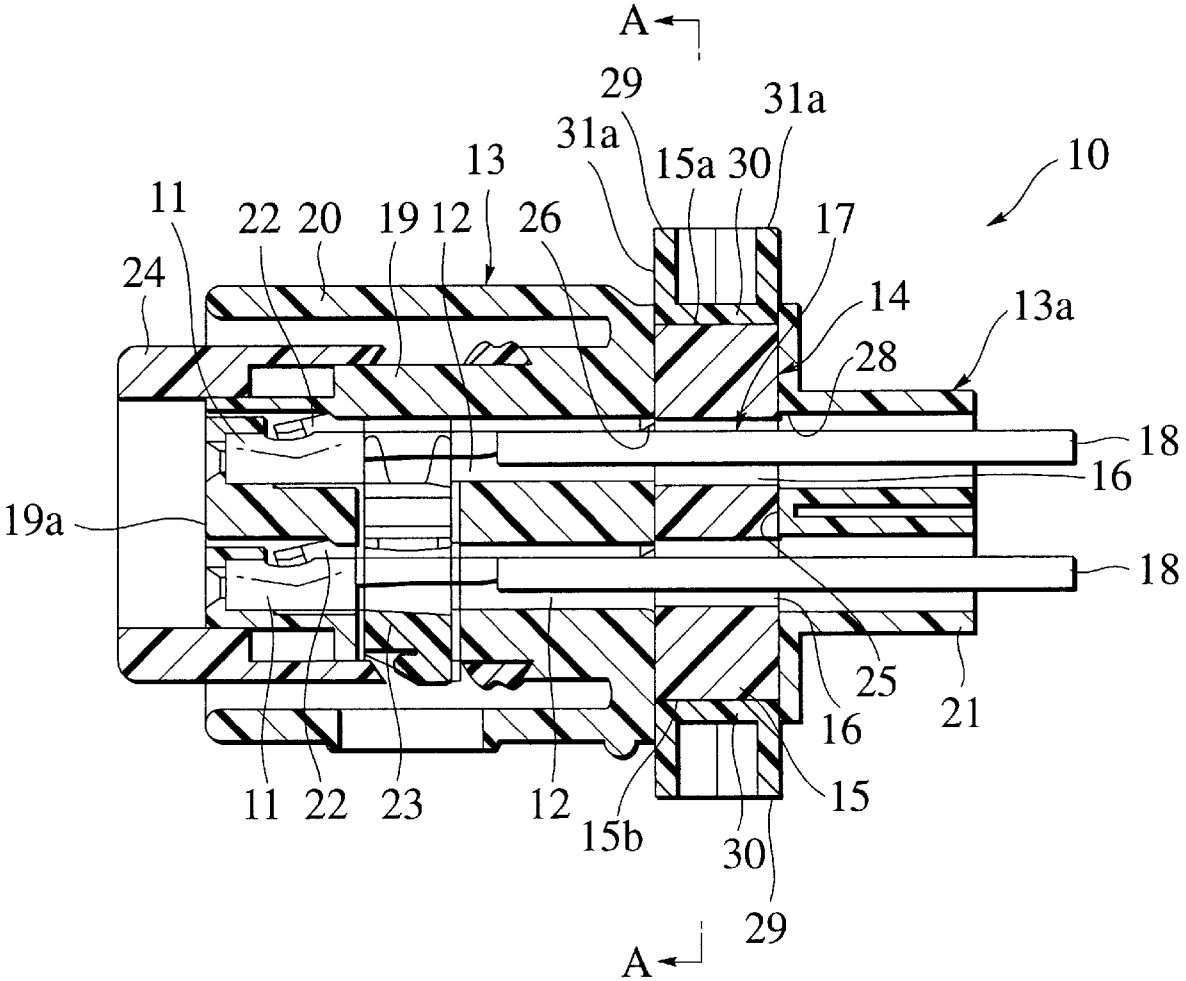
FIG. 3 is a longitudinal section of the waterproof connector in which the terminal is accommodated in the terminal accommodation chamber.
Figure 4:
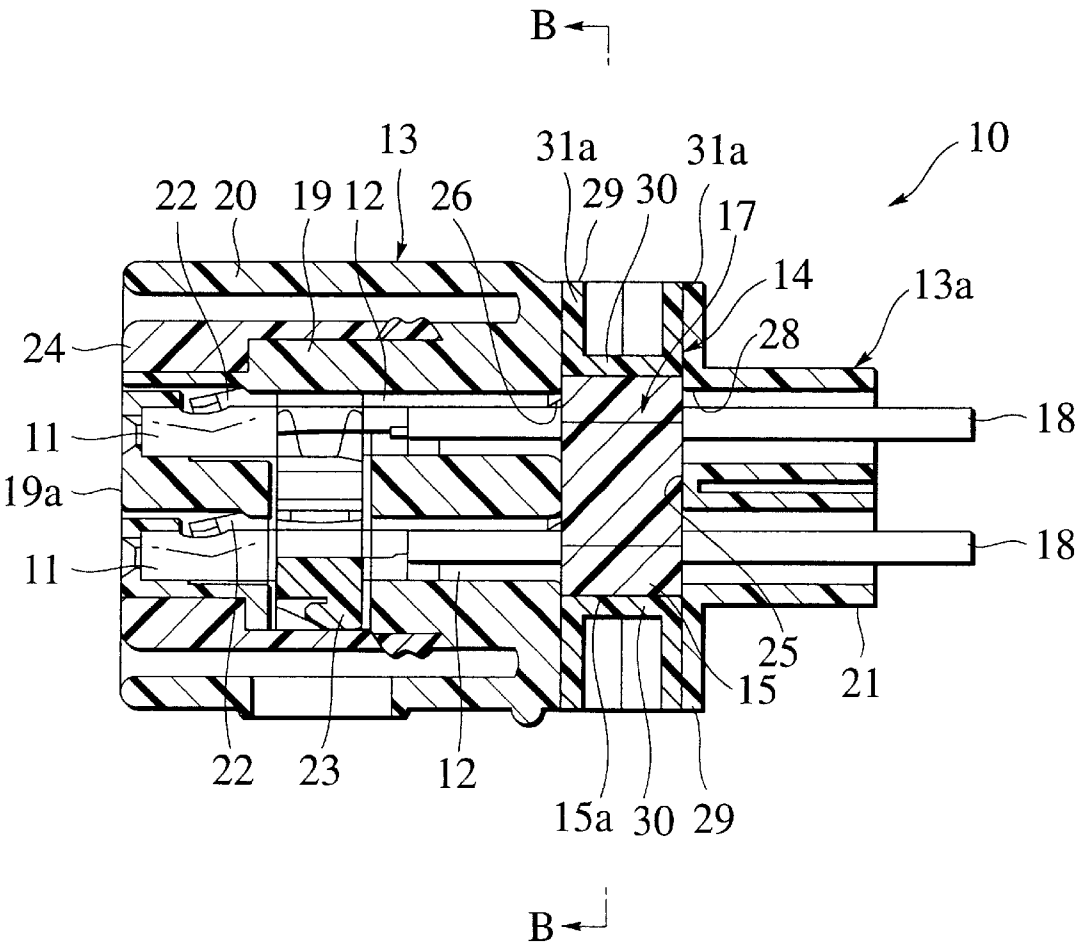
FIG. 4 is a longitudinal section of the waterproof connector in which the soft sealing material is pressed by push members, to be compressed in a sealing configuration.

FIG. 1 shows an appearance of a waterproof connector 10, and FIGS. 2, 3 and 4, structures of the connector 10.

As shown in FIGS. 1 and 2, the waterproof connector 10 has a connector housing 13 which includes a pair of upper and lower arrays of multiple terminal accommodation chambers 12 each adapted for accommodating a terminal 11, a vertically hollow common sealing portion 14 provided at a wire-letting rear end 13*a* of the housing 13 for sealing a pair of upper and lower arrays of multiple wire-letting horizontal passages straight connected for communication with the terminal accommodation chambers 12 in a matrix arrangement correspondence, and a parallelepiped body of soft sealing material 15 fitted in the sealing portion 14. In the waterproof connector 10 of the present embodiment, the soft sealing material 15 has a pair of upper and lower common insertion holes 16 formed therethrough to be greater in section than the terminal 11, e.g. with a height dimension L2 greater than a maximum height dimension L1 of the terminal 11 in a normal position in which it (11) is to be accommodated, and the sealing portion 14 defines a sealing material accommodation space 17 in which the soft sealing material 15 is fitted in position. Further, in the sealing portion 14, there are vertically slidably fitted a pair of upper and lower parallelepiped push members 29 for pressing the soft sealing material 15 to be compressed in the sealing material accommodating space 17, from the initial normal configuration described to a sealing configuration in which the insertion holes 16 are pressed flat and tightly contact and adhere on electric wires 18 connected to the terminals.

The housing 13 comprises an internal body 19, a waterproof hood portion 20 integrally formed on an outer side of the body 19, and a base 21 integrally formed on a rear end of the body 19. The base 21 is provided, at the side of the body 19, with the sealing portion 14. The terminal accommodation chambers 12 are formed in two arrays in the body 19, and a plastic engaging lance 22 is projected from a bottom of a wall in each terminal accommodation chamber 12.

A spacer 23, which is movable along a crossing direction to an insertion direction in which the terminal 11 is accommodated in the terminal accommodation chambers 12, is assembled at a provisional engagement position in the body 19. By moving the spacer 23 to a regular engagement position, the spacer 23 is accommodated in the terminal accommodation chamber 12 and brought into engagement with the engaging lance 22, and the spacer 23 locks the terminal 11 which is prevented from dropping out, thereby preventing the terminal from dropping out of the terminal accommodation chamber 12 in a double locking manner. A slide member 24 is mounted on the body 19 at the side of a fitting surface 19*a* to which a mating connector is fitted. By moving the slide member 24 toward the body 19, the spacer 23 is moved from the provisional engagement position to the regular engagement position.

The sealing portion 14 is provided with a through hole 25 which vertically passes through the sealing portion 14 and has a rectangular section. Opposing inner walls 25*a* and 25*b* of the through hole 25 are formed with terminal insertion openings 26 and 28 which are in communication with the terminal accommodation chambers 12 and terminal introducing holes 27 of the base 21. The sealing material accommodation space 17 in which the soft sealing material 15 is to be accommodated is located between the base 21 and the body 19.

The soft sealing material 15 is formed as a block, and the two terminal insertion holes 16 and 16 in the form of a laterally elongate slit are formed in the soft sealing material 15 and extend therethrough in the insertion direction of the terminal 11. The height L2 of the terminal insertion hole 16 is set greater than the height L1 of the terminal 11 as described, and the height L2 is set that the terminal 11 does not scrape an inside of the insertion hole 16 when the terminal 11 is inserted through the terminal insertion hole 16. In a state in which the soft sealing material 15 is accommodated in the sealing material accommodation space 17, the terminal insertion holes 16 match in height with arrays of terminal insertion openings 26 and 28 of wire-letting passages, and after the terminals inserted from the terminal introducing holes 27 (as wire-letting passages) in the base 21 have passed through the terminal insertion holes 16, the terminal can be inserted in the terminal accommodation chambers 12 with ease.

The soft sealing material 15 is pressed and shrunk by the push members 29 and 29 disposed at vertically opposite sides of the electric wire insertion holes 16, the electric wire insertion holes 16 are pressed flat, so that the soft sealing material 15 tight contacts on the outer periphery of each electric wire 18.

Each of the push member 29 is formed into a box-like shape comprising four side walls 31*a*, 31*b*, 32*a* and 32*a* rising from a plate-like abutment bottom 30 abutting against an upper surface 15*a* (or a lower surface 15*b*) of the soft sealing material 15. Reinforcing plates 35 and 35 connecting opposite corners are provided in the push member 29 in a crossing manner. Locking projections 33 and 33 (only one of them is illustrated in FIG. 1) are provided on outer peripheries of the side walls 32*a* and 32*a*. Each of the locking projections 33 includes a slope surface 33*a* and a vertical surface 33*b*, and the soft sealing material 15 is held in the compressed state by engaging the locking projections 33 and 33 with rectangular locking holes 34 and 34 provided on the opposite side walls 14*a* and 14*a* of the sealing portion 14. In a state in which the push members 29 and 29 are set to the upper and lower openings of the sealing portion 14, the slope surfaces 33*b* and 33*b* abut against the edges of the opening 35.

A waterproofing method for the waterproof connector 10 will be explained next.

First, as shown in FIG. 2, the soft sealing material 15 is set in the sealing material accommodation space 17. In this case, the terminal insertion hole 16 of the soft sealing material 15 is in communication with the openings 26 at the side of the terminal accommodation chamber 12 and the opening 28 at the side of the terminal introducing hole 27. From this state, the terminal 11 of the electric wire 18 is inserted into the terminal introducing hole 27 of the base 21, and after the terminal 11 is inserted through the terminal insertion hole 16, the terminal 11 is accommodated in the terminal accommodation chamber 12. At that time, as shown in FIGS. 3 and 5A, the terminal can be inserted through the terminal insertion hole 16 without touch on the inner wall of the terminal insertion hole 16, or without damaging the inner wall of the terminal insertion hole 16 even if the terminal 11 should touch the inner wall.

In a state in which the terminal 11 is accommodated in the terminal accommodation chamber 12, the engaging lance 22 engages the terminal 11 so that the terminal is prevented from dropping out of the terminal accommodation chamber 12. Further, by moving the slide member 24 toward the body 19 from this state, the spacer 23 located in the provisional engagement position is moved to the regular engagement position, and the spacer 23 engages the terminal 11. With this operation, the terminal 11 is locked in the terminal accommodation chamber 12 by the two engagements, i.e., the engagement with the engaging lance 22, and the engagement with the spacer 23.

Figure 5B:
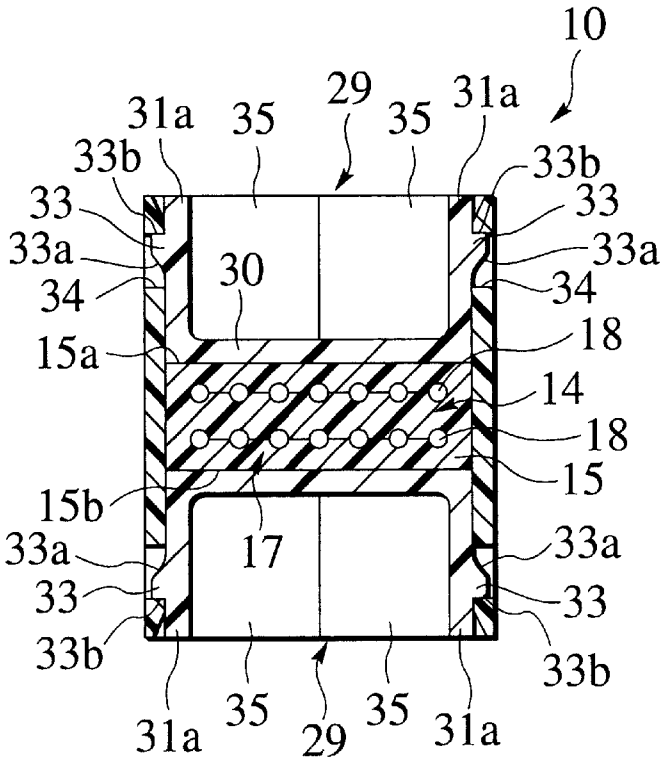
FIG. 5B is a section along line B—B of FIG. 4.
Figure 5A:
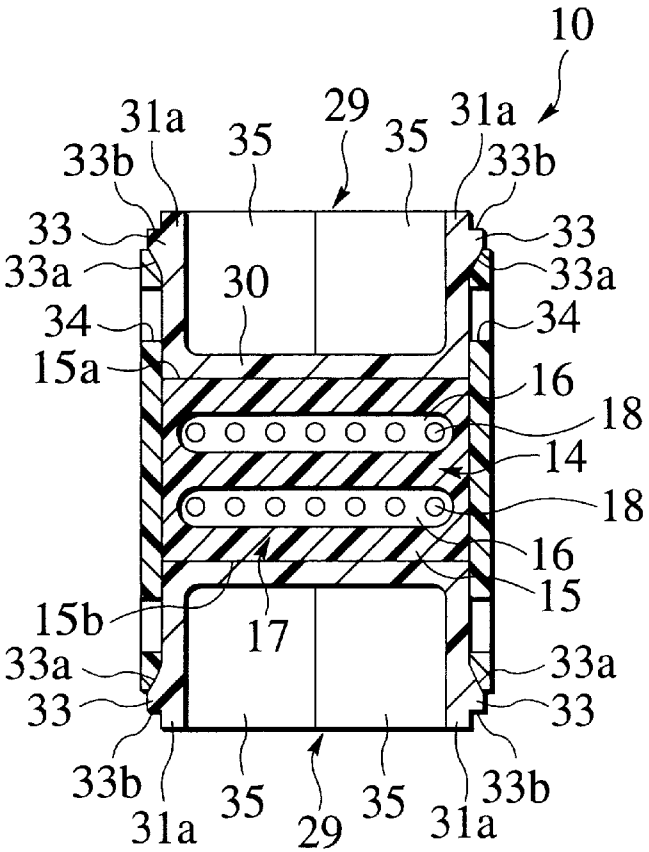

Next, as shown in FIGS. 4 and 5B, when the soft sealing material 15 is pressed by moving the push members 29 and 29 in directions to approach each other, the inner wall of the terminal insertion hole 16 is tightly carried with and tight contacted on the outer periphery of the electric wire 18. Further, by engaging the locking projection 33 with the locking hole 34, the state in which the soft sealing material 15 is pressed by the push members 29 and 29 is held. With this operation, water is prevented from entering from the space between the outer periphery of the electric wire 18 and the soft sealing material 15.

According to the present embodiment, the dimension of the terminal insertion hole 16 provided in the soft sealing material 15 is set greater in section than the dimension of the terminal 11, and even if the terminal 11 is inserted through the terminal insertion hole 16, the soft sealing material 15 should not adhere to the terminal 11. When the terminal is connected to the mating terminal, the soft sealing material 15 which is the insulator is not interposed between the terminals, it is possible to enhance the sureness of the electrical connection.

After the terminal is inserted through the terminal insertion hole 16 and is accommodated in the terminal accommodation chamber 12, the soft sealing material 15 is pressed by the push members 29 and 29, and the soft sealing material 15 is tightly carried with and tight contacted on the outer periphery of the electric wire 18, so that water can be prevented from entering the terminal accommodation chamber 12.

Further, the push members 29 and 29 are held in a state in which they press the soft sealing material 15 by the locking hole 34 and the locking projection 33, so that the sealing performance can reliably be maintained.

Furthermore, when the terminal 11 is inserted through the terminal insertion hole 16, the terminal 11 should not scrape the soft sealing material 15, the soft sealing material 15 is prevented from being damaged, the flowing-in amount should not be varied, and it is possible to reliably prevent the sealing performance from being deteriorated.

According to an aspect of the embodiment, a waterproof connector comprises: a housing including a terminal accommodation chamber in which a terminal is accommodated, a sealing portion provided at a rear end of an electric wire outlet side of the housing for sealing the inside of the terminal accommodation chamber, and a soft sealing material assembled in the sealing portion, wherein the soft sealing material is provided with an insertion hole greater in section than the terminal, the sealing portion is provided with a sealing material accommodation space in which the soft sealing material is inserted, and the sealing portion is provided with push members for tightly adhering and tight contacting the soft sealing material in the sealing material accommodation space to an outer periphery of the electric wire by pressing the soft sealing material to shrink the insertion hole.

According to this aspect, in a state in which the soft sealing material is accommodated in the sealing material accommodation space, even if the terminal is inserted through the insertion hole and accommodated in the terminal accommodation chamber, the insertion hole is set greater than the outer diameter of the terminal, the soft sealing material does not adhere to the terminal. The soft sealing material is not scraped by the terminal. The soft sealing material is pressed by the push members and tightly adhered and tight contacted to the outer periphery of the electric wire, thereby permitting to secure the waterproof performance.

Accordingly, in a state in which the soft sealing material is accommodated in the sealing material accommodation space, even if the terminal is inserted through the insertion hole and accommodated in the terminal accommodation chamber, the insertion hole is set greater than the outer diameter of the terminal, the soft sealing material does not adhere to the terminal.

Moreover, the soft sealing material is not scraped by the terminal. The soft sealing material is pressed by the push members and tightly adhered and tight contacted to the outer periphery of the electric wire, the waterproof performance can be secured.

According to another aspect, the push members are disposed at opposite sides between which the insertion hole of the soft sealing material accommodated in the sealing material accommodation chamber is interposed, and the soft sealing material is pressed by moving the opposed push members in directions approach each other.

According to this aspect, by moving the push members disposed at opposite sides of the soft sealing material in directions to approach each other, the soft sealing material is easily and reliably pressed.

Accordingly, by moving the push members disposed at opposite sides of the soft sealing material in directions to approach each other, the soft sealing material can easily and reliably pressed.

According to another aspect, the sealing portion is provided with locking holes, and each of the push members is provided with a locking projection which is inserted and locked in each of the locking holes to hold a pressing state in a state in which the soft sealing material is pressed.

According to this aspect, the pressed state of the soft sealing material by the push members is maintained by inserting and engaging the locking projection tot he locking hole to hold the push members to the sealing portion.

Accordingly, the pressed state of the soft sealing material by the push members can be maintained by inserting and engaging the locking projection to the locking hole to hold the push members to the sealing portion.

According to another aspect of the embodiment, there is provided a waterproofing method using a waterproof connector of such arrangement, wherein in a state in which the soft sealing material is accommodated in the sealing material accommodation space of the sealing portion, the terminal of an end of the electric wire is inserted through the insertion hole of the soft sealing material and is accommodated in the terminal accommodation chamber, the soft sealing material is pressed by the push members to shrink the insertion hole, thereby tightly adhering and tight contacting the soft sealing material to the outer periphery of the electric wire.

According to this aspect, even if the terminal of the end of the electric wire is inserted through the insertion hole of the soft sealing material in the sealing material accommodation space and is accommodated in the terminal accommodation chamber, the insertion hole is set greater than the outer diameter of the terminal, the soft sealing material should not adhere to the terminal. Further, the soft sealing material is not scraped by the terminal, and it is possible to prevent the sealing performance of the soft sealing material from being deteriorated.

Accordingly, even if the terminal of the end of the electric wire is inserted through the insertion hole of the soft sealing material in the sealing material accommodation space and is accommodated in the terminal accommodation chamber, the insertion hole is set greater in section than the terminal, the soft sealing material does not adhere to the terminal. Further, the soft sealing material is not scraped by the terminal, and it is possible to prevent the sealing performance of the soft sealing material from being deteriorated.

According to another aspect, the push members are disposed at opposite sides between which the insertion hole of the soft sealing material accommodated in the sealing material accommodation chamber is interposed, and the soft sealing material is pressed by moving the opposed push members in directions approach each other.

According to this aspect, by moving the push members disposed at opposite sides of the soft sealing material in directions to approach each other, the soft sealing material is easily and reliably pressed.

While preferred embodiments of the present invention have been described using specific terms, such description is for illustrative purposes, and it is to be understood that changes and variations may be made without departing from the spirit or scope of the following claims.

What is claimed is:

1. A waterproof connector comprising:

a terminal connected to an electric wire;

a housing having a chamber for accommodating the terminal and a passage for passing the electric wire;

a flexible sealing body for sealing the passage, the flexible sealing body having an insertion hole having a periphery, the terminal and electric wire being inserted therethrough to the chamber, wherein the insertion hole is larger in section than the terminal; and a pressing structure contacting and compressing, transversely to the passage, the flexible sealing body to seal the passage by maintaining the flexible sealing body under transverse compression such that some portions of the periphery of the insertion hole tightly contact each other and such that other portions of the periphery of the insertion hole tightly contact the electric wire.

2. The waterproof connector of claim 1, wherein the pressing structure comprises a plurality of pressing members arranged about the passage.

3. The water proof connector of claim 1, wherein the pressing structure comprises a push member contacting the flexible sealing body, and locking means for locking the push member relative to the passage.

4. A waterproof connector fabrication method comprising the steps of:

providing a housing having a chamber with a passage;

connecting a terminal to an electric wire;

providing a flexible sealing body having an initial configuration with an insertion hole larger in section than the terminal, the insertion hole having a periphery;

inserting the terminal through the insertion hole to the chamber, thereby accommodating the terminal in the chamber with the electric wire passing through the passage; and contacting the flexible sealing body with a pressing structure to compress, transversely to the passage, the flexible sealing body from the initial configuration to a sealing configuration such that portions of the periphery of the insertion hole tightly contact each other and such that other portions of the periphery of the insertion hole tightly contact the electric wire, thereby sealing the passage.

5. A waterproof connector comprising:

a housing including a terminal accommodation chamber in which a terminal is accommodated, a passage in communication with the terminal accommodation chamber for passing an electric wire therethrough, the passage including a sealing portion at a rear end of the electric wire outlet side of the housing for sealing the inside of the terminal accommodation chamber, and a flexible sealing material assembled in the sealing portion, wherein the flexible sealing material has an insertion hole having a periphery, the insertion hole being greater in section than the terminal, the sealing portion includes a sealing material accommodation space in which the flexible sealing material is inserted, and the sealing portion includes push members configured to cause portions of the periphery of the insertion hole to tightly adhere to each other and to cause other portions of the periphery of the insertion hole of the flexible sealing material in the sealing material accommodation space to tightly adhere to and tightly contact an outer periphery of the electric wire by compressing, transversely to the passage, the flexible sealing material to shrink the insertion hole.

6. The waterproof of connector of claim 5, wherein the push members are disposed at opposite sides between which the insertion hole of the flexible sealing material accommodated in the sealing material accommodation chamber is interposed, and the flexible sealing material is compressed transversely to the passage by moving the opposed push members in directions approaching each other.

7. The waterproof connector of claim 5, wherein the sealing portion is provided with locking holes, and each of the push members is provided with a locking projection which is inserted and locked in each of the locking holes to hold the push members in a pressing state in which the flexible sealing material is compressed transversely to the passage.

8. A waterproofing method using a waterproof connector according to claim 5, wherein in a state in which the flexible sealing material is accommodated in the sealing material accommodation space of the sealing portion, the terminal of an end of the electric wire is inserted through the insertion hole of the flexible sealing material and is accommodated in the terminal accommodation chamber, the flexible sealing material is compressed transversely to the passage by the push members to shrink the insertion hole, thereby causing portions of the periphery of the insertion hole to tightly adhere to each other and causing other portions of the periphery of the insertion hole to tightly adhere and tightly contact the outer periphery of the electric wire.

9. The waterproofing method of claim 8, wherein the push members are disposed at opposite sides between which the insertion hole of the flexible sealing material accommodated in the sealing material accommodation chamber is interposed, and the flexible sealing material is compressed transversely to the passage by moving the opposed push members in directions approach each other.

10. A waterproof connector comprising:

a terminal connected to an electric wire;

a housing having a chamber for accommodating the terminal and a passage for passing the electric wire;

a flexible sealing body for sealing the passage when in a sealing configuration, the flexible sealing body having an insertion hole for the terminal to be inserted therethrough to the chamber, the insertion hole having a periphery; and a pressing structure compressing, transversely to the passage, the flexible sealing body from an initial configuration, where the insertion hole is larger in section than the terminal, to the sealing configuration, such that some portions of the periphery of the insertion hole are in tight contact with each other and such that other portions of the periphery of the insertion hole tightly contact the electric wire, wherein the pressing structure comprises a push member contacting the flexible sealing body, and locking means for locking the push member relative to the passage.

11. A waterproof connector of claim 1, wherein the housing comprises a transverse hole relative to and in communication with the passage the flexible sealing body is disposed in the hole, and the pressing structure is disposed in the hole.

12. A waterproof fabrication method of claim 4, wherein the housing comprises a transverse hole relative to and in communication with the passage, the flexible sealing body is disposed in the hole, and the pressing structure is disposed in the hole.

13. A waterproof connector comprising:

a terminal connected to an electric wire;

a housing having a chamber for accommodating the terminal;

a sealing portion adjacent a rear end of an electric wire outlet side of the housing, the sealing portion including a vertical through hole;

a flexible sealing body in the sealing portion, the flexible sealing body having an insertion hole, the terminal and electric wire being inserted therethrough to the chamber, wherein the insertion hole is larger in section than the terminal, and wherein the flexible sealing body is configured such that said insertion hole tightly contacts the electric wire when said flexible sealing body is compressed; and at least one pressing member positioned within the vertical through hole of the sealing portion, the at least one pressing member contacting and compressing the flexible sealing body such that said insertion hole tightly contacts the electric wire.

14. A waterproof connector comprising:

a terminal connected to an electric wire;

a housing having a chamber for accommodating the terminal;

a sealing portion adjacent a rear end of an electric wire outlet side of the housing, the sealing portion including a vertical through hole;

a flexible sealing body in the sealing portion, the flexible sealing body having an insertion hole, the terminal and electric wire being inserted therethrough to the chamber, wherein the insertion hole is larger in section than the terminal, and wherein the flexible sealing body is configured such that said insertion hole tightly contacts the electric wire when said flexible sealing body is compressed; and two pressing members positioned within the vertical through hole of the sealing portion, one pressing member being positioned above the flexible sealing body and the other pressing member being positioned below the flexible sealing body, wherein the pressing members contact and compress the flexible sealing body such that said insertion hole tightly contacts the electric wire.

15. A waterproof connector comprising:

a plurality of terminals, each terminal connected to an electric wire;

a housing having a plurality of chambers for accommodating the terminals;

a sealing portion adjacent a rear end of an electric wire outlet side of the housing;

a single flexible sealing body in the sealing portion, the single flexible sealing body having an insertion hole with a periphery, the terminals and electric wires being inserted therethrough to the chamber, wherein the insertion hole is larger in section than the terminals; and a pressing structure contacting and compressing the single flexible sealing body such that portions of the periphery of said insertion hole tightly contact the electric wires to form a waterproof seal.

16. The waterproof connector of claim 1, wherein the periphery of the insertion hole is a wall.

17. The waterproof connector of claim 1, wherein the insertion hole is an elongated slot, and wherein a wall forms the periphery of the insertion hole.

18. The waterproof connector of claim 1, wherein the insertion hole is oval in shape.

* * * * *